United States Patent [19]

Mayer

[11] Patent Number: 4,506,235

[45] Date of Patent: Mar. 19, 1985

[54] EMI PROTECTED CABLE, WITH CONTROLLED SYMMETRICAL/ASYMMETRICAL MODE ATTENUATION

[76] Inventor: Ferdy Mayer, 43 rue du 11 novembre 1918, 94700 Maisons Alfort, France

[21] Appl. No.: 351,493

[22] Filed: Feb. 23, 1982

[51] Int. Cl.[3] ..... H01P 1/00; H01P 3/02

[52] U.S. Cl. ..... 333/12; 174/36; 333/236

[58] Field of Search ..... 333/12, 236, 243, 184; 174/36, 106 R, 106 SC, 34, 35, 32

[56] References Cited

U.S. PATENT DOCUMENTS 4,301,428 11/1981 Mayer ..... 333/12
4,371,742 2/1983 Manly ..... 174/36
4,371,745 2/1983 Sakashita ..... 174/36 X

FOREIGN PATENT DOCUMENTS 2547152 4/1977 Fed. Rep. of Germany ..... 174/36
2622297 12/1977 Fed. Rep. of Germany ..... 174/36

*Primary Examiner*—Paul Gensler
*Attorney, Agent, or Firm*—Oblon, Fisher, Spivak, McClelland & Maier

[57] ABSTRACT

A cable with at least two insulated conductors wherein the symmetrical mode electromagnetic field between the conductors is essentially confined in a low loss dielectric medium and globally surrounded at least partially by a magnetic absorptive insulating composite, attenuating the asymmetrical current mode and providing a magnetic shielding effect against outside electromagnetic interference.

The electromagnetic field of the symmetrical mode is confined between the two conductors while the electromagnetic field of the common mode is absorbed in the magnetic absorptive insulating composite.

5 Claims, 10 Drawing Figures

EMI PROTECTED CABLE, WITH CONTROLLED SYMMETRICAL/ASYMMETRICAL MODE ATTENUATION

The present invention has for its object an improved electrical transmission cable with two conductors, protected against electromagnetic interferences (EMI).

This protection is useful with regard to interference from outside fields which can generate in the cable an electrical current which disturbs the transmission of signals, as well as with regard to environmental perturbations due to the waves transmitted by the cable as a result of the passage of signals.

The invention has more particularly for its object a common mode selective attenuation cable. This notion will be explained in connection with FIG. 1 of the appended drawings, which represents schematically a conventional circuit. A signal generator 1 and a load 2 are connected by a cable formed by two twisted conductors 3A and 3B. At a given moment, electrical currents IA and IB are present in conductors 3A and 3B respectively. These currents can be each the sum of two currents of different origins: one current caused by generator 1 which has the same values but opposed directions in said conductors +Id and −Id, usually called symmetrical or differential currents, and a current Ic, generated between the conductors and ground under the action of interfering electromagnetical waves H. Said current Ic is the same for both conductors 3A and 3B, and is usually called an asymmetrical or common mode current.

$$IA = Ic + Id$$

$$IB = Ic - Id$$

It is an object of the present invention to provide a cable with common mode attenuation in both conductors. Such a cable is useful in many applications: metrology, for example or for computer networks.

Coaxial cables are known for avoiding interference. But the use of coaxial cables presents drawbacks, particularly the difficulty of achieving on line connections.

The present invention has for its object a cable with at least two conductors protected against electromagnetic interference (EMI) with an open structure, as compared to coaxial cables with closed or shielded structure.

Twisted pair cables are well known as an alternative to shielded cables for transmission of low level signals, and more especially transducer signals. Coupling (to outside EMI-field) rejection is achieved by cancellation of the induced interference. Additional ES (electrostatic) (and EM) shielding by conductive (and magnetic) outer layers are used when very high immunity is needed. Such shields have to be grounded to be effective. Nowadays, in many cases, reliable grounding may cause a problem, such as in semi-mobile use, a typical case being sensor lines inside the automobile.

According to the present invention, in a cable with at least two insulated conductors, the symmetrical mode electromagnetic field between the conductors is essentially confined in a low loss dielectric medium and globally surrounded at least partially by a magnetic absorptive insulating composite, attenuating the asymmetrical current mode and providing a magnetic shielding effect against outside electromagnetic interference.

Various other objects, features and attendant advantages of the present invention will be more fully appreciated as the same becomes better understood from the following detailed description of the present invention when considered in connection with the accompanying drawings.

Figure 2:
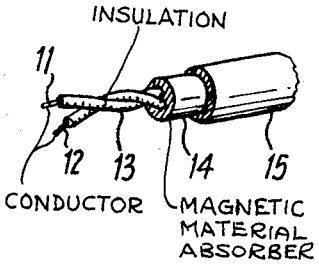
FIG. 2 is a representation of a typical low performance implementation.

The cable of FIG. 2 is comprised for example of two conductors 11, 12 of solid copper of 1 mm diameter coated with an insulating sheath 13 of 0.5 mm thickness which may be polyvinylchloride or the like. The material of the insulating sheath should be a low loss dielectric medium. The two conductors are twisted as is known, a typical twist pitch being 12 mm. The two insulated conductors are embedded, preferably by an extrusion process in a cylindrical layer of about 6 mm overall diameter of flexible absorptive composite 14 such as the one described in French Patent Specification No. 2,410,343 (corres. to U.S. Pat. continuation-in-part application Ser. No. 19,799 now abandoned) comprising one continuous matrix of a flexible binder having embedded therein manganese-zinc ferrite particles, having a non-homogeneous particulate mix consisting essentially of smaller particles of 10–100$\mu$ and larger particles of 150–300$\mu$, but wherein said particles are at least as large as the size of the magnetic domain of the ferrite, and wherein said particles are present in said binder in an amount of from 85% by weight to 94% by weight.

Other composites which may be used in a cable according to present invention are described e.g. in the U.S. Pat. No. 3,309,633 of Jan. 10, 1963.

The cable so formed is protected by a conventional outer sheath 15 which may be extruded from polyvinylchloride.

Figure 3:
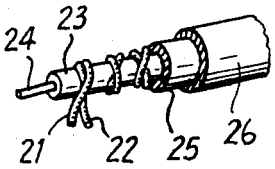
FIG. 3 is a representation of a typical high performance implementation.

FIG. 3 shows a typical high performance implementation. There is also two wires 21, 22 which may be varnish insulated, twisted and would around a core 23 of an electromagnetic absorptive composite material such as above described. For purpose of extrusion, the core 23 may contain a draw thread 24. The whole may be surrounded by a layer 25 of the same absorptive composite as core 23. The cable is also protected by a conventional outer sheath 26 of extruded polyvinylchloride. These two cables may also include parallel non twisted wires, when a lower protection is accepted.

These new cables use a magnetic core and/or sheath which is non conductive and act as a non-grounded shield for EMI (electromagnetic interference) electric and magnetic fields, by channelling electromagnetic flux around the twisted pair. In addition, in a configuration where the cable is lying near the ground (close to ground) this sheath absorbs selectively common mode signals.

A 2 m long twisted pair transducer cable on a car engine is replaced by a cable according to FIG. 2 using a clock rate of 30 MHz. Shielding improvement will be 13 db overall the frequency range where the magnetic composite is effective, coupling rejection improvement will be about 27 db, i.e. an overall immunity improvement of 40 db is to be expected, which will come close to or even exceed the performance of a coaxial cable.

The useful signal attenuation (differential mode) will be negligible, the common mode signal attenuation being about 6 db for this implementation shown in FIG. 2 and may be increased to over 90 db with the cable of FIG. 3.

Figure 7:
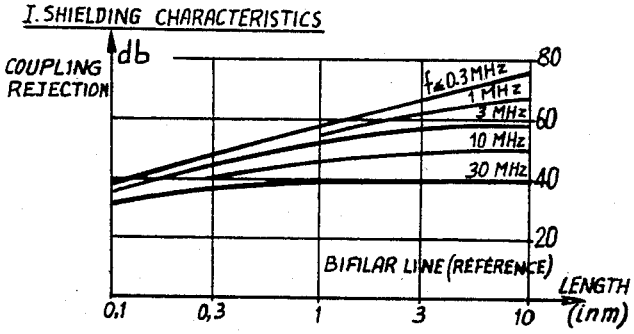
FIG. 7 is a graph I showing the attenuation due to the twisting of the wires.

Graph I shown in FIG. 7 shows EMI coupling rejection by the twist, over a normal bifilar line, which is improved by about 13 db (by the magnetic shield effect) and up to 27 db (by the reduced wavelength due to the magnetic layer) i.e. a total improvement of up to 40 db over a similar non protected twisted line.

Figure 8:
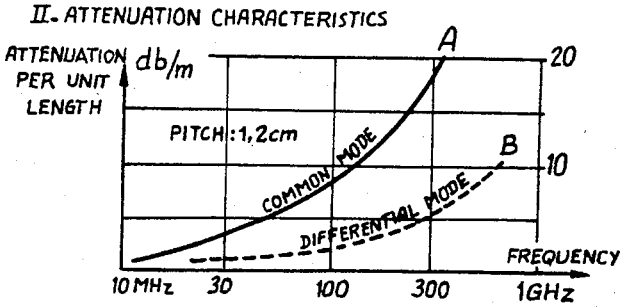
FIG. 8 is a graph II showing the common mode attenuation due to the magnetic absorptive insulating composite.

Graph II shown in FIG. 8 shows the EMI attenuation for common (curve A) and differential (curve B) signals, demonstrating the selective common mode absorption.

Figure 4:
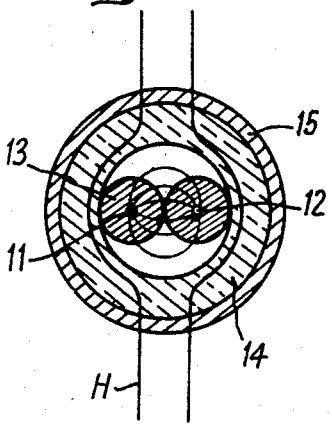
FIG. 4 is a sectional view of the cable of FIG. 2.
Figure 5:
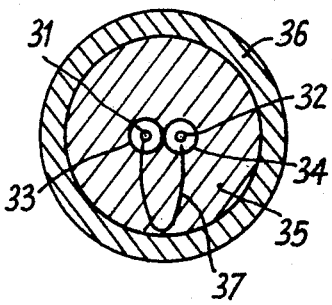
FIG. 5 is a view similar to FIG. 2 for a modified embodiment.

Turning to FIGS. 4 and 5, there is shown in FIG. 4 a cross section of the cable of FIG. 2 with a figuration of the lines of the electromagnetic field between the two conductors 11 and 12. This field is passing essentially in a low loss medium where it is confined: the insulating sheath 13 of conductors 11 and 12. It ensures that the differential mode attenuation is relatively low. So, on Graph II the curve B is under curve A. It is possible to modify the position of curve B by selecting the dielectric characteristics of the insulating sheath 13, i.e. its thickness and/or the dielectric constant $\epsilon$. On FIG. 5, there is represented in a cross sectional view of a modified embodiment of a cable in which two conductors 31, 32 insulated by sheath 33, 34 are embedded in a low loss medium 35 surrounded by the magnetic absorptive insulating composite 36. In this case, the two wires 31, 32 are more distant from the composite 36 so that only a little part of the field 37 is absorbed in said composite. For such a cable, the differential attenuation (curve B of Graph II) may be reduced to very low values. To have low symmetric attenuation, both conductors should be relatively as close as possible. In an embodiment, the two wires can be varnish insulated and stuck together. (If a metallic shielding were disposed around low loss medium 35, inside the composite 36, differential attenuation would be far similar).

Figure 1:
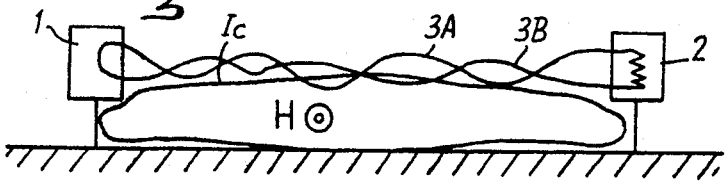
FIG. 1 is a schematic representation of a conventional signal line wiring.

There is then low or negligible attenuation in symmetrical mode. To the contrary, if the insulating sheath 13 is reduced to a minimum, differential attenuation (curve B) is higher and at the limit will merge with curve A, as is the case with the cable of FIG. 1*c* of the above cited French Pat. No. 2,410,343.

In FIG. 4, an outside parasite magnetic field H is shown, as passing through composite 14, without interfering with the conductors. The field does not pass between the conductors which are so protected against outer influences. This represents the shielding effect.

Figure 6:
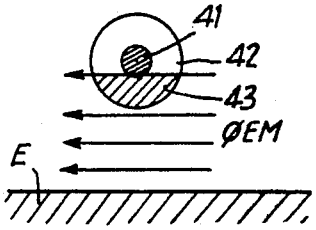
FIG. 6 is a schematic representation of the common mode field.

The common mode suppression effect is represented in FIG. 6. The cable is schematically shown as a conductor 41 surrounded by the magnetic absorptive insulating composite 42. (In this effect the two conductors are exposed to the same field).

Between conductor 41 and earth E, there is an electromagnetic. field$\emptyset$EM, which is partly absorbed in the part 43 of composite 42, without so interfering with conductor 41. The nearer the cable is to ground, the more the common mode field is absorbed. At the limit, the cable may be covered by a conductive layer (braid, etc . . . ) surrounding the insulating composite. As an example, the cable may be protected by a shielding according to French Pat. No. 79 18065 or U.S. patent application Ser. No. 166,403 now U.S. Pat. No. 4,383,225, of July 7, 1980, comprising two flexible conductive screenings separated by one magnetic absorptive insulating medium.

Figure 9:
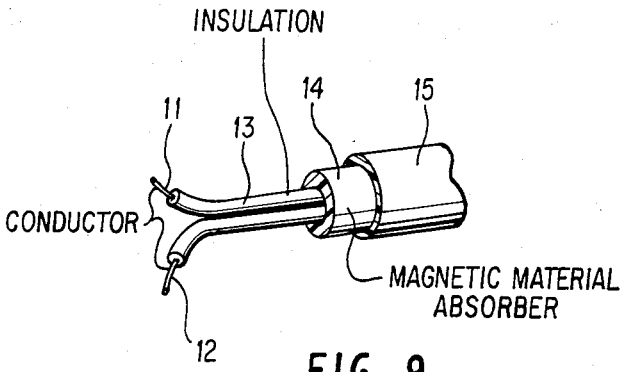
FIG. 9 is a representation of a second embodiment of a low performance implementation.
Figure 10:
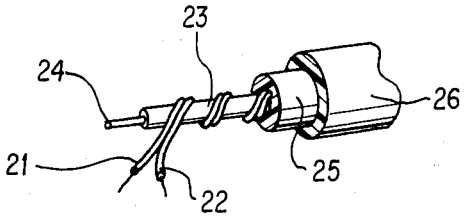
FIG. 10 is a representation of a second embodiment of a high performance implementation.

FIG. 9 shows another embodiment similar to FIG. 2 with similar reference numbers identifying the various parts. In this figure, however, the conductors are not twisted as in FIG. 2, but rather are parallel. Similarly, FIG. 10 shows a second embodiment similar to FIG. 3. In FIG. 10, the two conductors are wrapped around the center core but are not twisted around each other as in FIG. 3.

Basic applications relate to EMI protected low signal cables, where a classical (grounded) shield is inappropriate, and where practical signal transfer needs to be enhanced by selective common mode absorption and frequency selective absorption.

EXAMPLES

Tests on HV circuits (transducers on ignition circuits, etc)

Susceptibility test probes (automotive EMC)

E and H field probing

Instrumentation cables, in difficult environment (nuclear, bio-medical)

Cable for computer networks (Omninet, Ethernet, Z-net, VME, Versabus, Datapoint, Hinet, etc)

Multiple conductors can be enclosed under the same shield. Additional conductive shields can be applied for special performances and more especially for increased shielding effect and lower differential mode attenuation.

Differential mode attenuation can be increased above common mode attenuation, i.e. the differential mode cable shows a low pass filter effect, with a cut-off frequency variable with length.

Magnetic shield is effective to over 3 GHz; it is field intensity independent, up to magnetic fields of 120 A/cm with the magnetic absorptive insulating composite of the above cited French Pat. No. 2,410,343.

I claim:

1. A cable with at least two insulated conductors, wherein said conductors are at least partially under the influence of an absorptive composite, so as to introduce absorption to the main propagation mode of the line, wherein the symmetrical mode electromagnetic field between the conductors is confined in a low loss dielectric medium in a controlled manner according to the characteristics of the insulating medium surrounding the conductors and globally surrounded at least partially by a magnetic absorptive insulating ferrite composite, attenuating primarily the asymmetrical current mode and providing a magnetic shielding effect against outside electromagnetic interference.

2. A cable according to claim 1 comprising two insulated conductors which are disposed parallel side by side and surrounded by the magnetic absorptive insulating composite.

3. A cable according to claim 1, comprising two insulated conductors which are twisted together and surrounded by the magnetic absorptive insulating composite.

4. A cable comprising two insulated conductors wound up side by side on a core made of a magnetic absorptive insulating composite, the assembly formed by said conductors wound up on said core being surrounded by a layer of said magnetic absorptive insulating composite, wherein the symmetrical mode electromagnetic field between the conductors is confined in a low loss dielectric medium in a controlled manner according to the characteristics of the insulating medium surrounding the conductors and globally surrounded by said layer of magnetic absorptive insulating composite, attenuating primarily the asymmetrical current mode and providing a magnetic shielding effect against outside electromagnetic interference.

5. A cable comprising two insulated conductors twisted together and would up on a core made of a magnetic absorptive insulating composite, the assembly formed by said conductors wound up on said core being surrounded by a layer of same magnetic absorptive insulating composite, wherein the symmetrical mode electromagnetic field between the conductors is confined in a low loss dielectric medium in a controlled manner according to the characteristics of the insulating medium surrounding the conductors and globally surrounded by said layer of magnetic absorptive insulating composite, attenuating primarily the asymmetrical current mode and providing a magnetic shielding effect against outside electromagnetic interference.

* * * * *